US007319361B2

(12) United States Patent
Jin

(10) Patent No.: US 7,319,361 B2
(45) Date of Patent: Jan. 15, 2008

(54) INTERNAL VOLTAGE GENERATION CIRCUIT OF A SEMICONDUCTOR DEVICE

(75) Inventor: Seung Eon Jin, Seoul (KR)

(73) Assignee: Hynix Semiconductor Inc., Gyuggi-Do (KR)

( * ) Notice: Subject to any disclaimer, the term of this patent is extended or adjusted under 35 U.S.C. 154(b) by 54 days.

(21) Appl. No.: 11/275,419

(22) Filed: Dec. 30, 2005

(65) Prior Publication Data

US 2007/0001752 A1 Jan. 4, 2007

(30) Foreign Application Priority Data

Jun. 29, 2005 (KR) ..... 10-2005-0057354

(51) Int. Cl.
*G05F 1/10* (2006.01)

(52) U.S. Cl. ..... 327/543; 327/530

(58) Field of Classification Search ..... 327/530, 327/538, 540, 541, 543; 323/313, 316
See application file for complete search history.

(56) References Cited

U.S. PATENT DOCUMENTS

| | | | | |
|---|---|---|---|---|
| 5,463,588 | A * | 10/1995 | Chonan | 365/226 |
| 5,821,808 | A * | 10/1998 | Fujima | 327/541 |
| 6,058,061 | A * | 5/2000 | Ooishi | 365/222 |
| 6,429,729 | B2 * | 8/2002 | Kobayashi et al. | 327/540 |
| 6,636,451 | B2 | 10/2003 | Park et al. | |
| 6,809,576 | B1 * | 10/2004 | Yamasaki | 327/540 |
| 6,842,382 | B2 | 1/2005 | Kim et al. | |
| 6,867,641 | B2 | 3/2005 | Kang et al. | |
| 6,996,023 | B2 * | 2/2006 | Kim | 365/226 |
| 7,046,576 | B2 * | 5/2006 | Kim et al. | 365/230.05 |
| 7,109,783 | B1 * | 9/2006 | Kondapalli et al. | 327/540 |
| 2003/0210090 | A1 * | 11/2003 | Kwak et al. | 327/540 |
| 2005/0099224 | A1 * | 5/2005 | Itoh | 327/541 |
| 2006/0017494 | A1 * | 1/2006 | Horiguchi et al. | 327/538 |
| 2007/0001750 | A1 * | 1/2007 | Jin | 327/540 |
| 2007/0013420 | A1 * | 1/2007 | Jin | 327/158 |

FOREIGN PATENT DOCUMENTS

| | | |
|---|---|---|
| KR | 1997-0051107 | 7/1997 |
| KR | 1999-0048308 | 7/1999 |
| KR | 1999-0081305 | 11/1999 |

* cited by examiner

*Primary Examiner*—Kenneth B. Wells
*Assistant Examiner*—Thomas J. Hiltunen
(74) *Attorney, Agent, or Firm*—Marshall, Gerstein & Borun LLP

(57) ABSTRACT

An internal voltage generation circuit of a semiconductor device is disclosed. The internal voltage generation circuit comprises a reference voltage generator for generating a reference voltage having different levels depending on different operation modes of the semiconductor device, an active voltage generator for generating an active internal voltage of a level based on the reference voltage, a standby voltage generator for generating a standby internal voltage of a level based on the reference voltage, and an active voltage generation controller for controlling the active voltage generator such that the active voltage generator outputs the active internal voltage in a specific period after completion of a self-refresh mode.

22 Claims, 5 Drawing Sheets

INTERNAL VOLTAGE GENERATION CIRCUIT OF A SEMICONDUCTOR DEVICE

FIELD OF THE INVENTION

This patent relates to an internal voltage generation circuit of a semiconductor device, and more particularly to an internal voltage generation circuit of a semiconductor device for, in a desired operation mode, particularly a self-refresh mode, lowering the level of internal voltage as compared with that in an active mode and supplying the resulting internal voltage to the semiconductor device, so as to reduce current consumption in the self-refresh mode, and restoring the level of internal voltage to a normal level for the active mode within a short time after the self-refresh mode is completed, so that the semiconductor device can smoothly perform a normal operation.

DESCRIPTION OF THE RELATED ART

In general, a semiconductor device, particularly a dynamic random access memory (DRAM), includes an internal voltage generation circuit that generates and supplies an internal voltage. The internal voltage generation circuit includes an active voltage generator and a standby voltage generator. The active voltage generator is a voltage generation circuit that has a larger current drive capability and acts to supply an internal voltage in an active period of the semiconductor device, namely, a period in which a row access operation is actually carried out. An active internal voltage refers to the internal voltage that is supplied from the active voltage generator. The standby voltage generator is a voltage generation circuit that has a smaller current drive capability and acts to always supply an internal voltage. A standby internal voltage refers to the internal voltage that is supplied from the standby voltage generator.

FIG. 1 is a block diagram showing the configuration of a conventional internal voltage generation circuit of a semiconductor device, and FIG. 2 is a timing diagram illustrating the operation of the conventional internal voltage generation circuit of the semiconductor device. The problem with the conventional internal voltage generation circuit will hereinafter be described with reference to these figures.

As shown in FIG. 1, the conventional internal voltage generation circuit comprises a reference voltage generator 110 for generating a reference voltage VREF having different levels depending on whether the semiconductor device is in a self-refresh mode or not, a standby voltage generator 120 for generating a standby internal voltage of a level based on the reference voltage VREF, and an active voltage generator 130 for generating an active internal voltage of a level based on the reference voltage VREF in response to a control signal IRAS which is enabled by a row access command.

The operation of the conventional internal voltage generation circuit with the above-stated configuration will hereinafter be described with reference to FIG. 2.

In order to reduce current consumption in the self-refresh mode, the reference voltage generator 110 outputs a reference voltage VREF2 lower than a reference voltage VREF1 in an active mode in the self-refresh mode. That is, the reference voltage generator 110 supplies the voltage VREF1 as the reference voltage VREF in a period before the semiconductor device enters the self-refresh mode, namely, in a period A in which a self-refresh signal SREF is disabled to a low level, and, thereafter, the voltage VREF2 as the reference voltage VREF in a period in which the semiconductor device enters the self-refresh mode and is then maintained at the self-refresh mode, namely, in a self-refresh mode period B in which the self-refresh signal SREF is enabled to a high level. As a result, an internal voltage VCORE that is outputted from the internal voltage generation circuit of FIG. 1 in the self-refresh mode period B becomes lower than that in period A. Thereafter, in a period after the semiconductor device exits the self-refresh mode, namely, in a period C in which the self-refresh signal SREF is disabled to a low level, the reference voltage generator 110 again supplies the voltage VREF1 as the reference voltage VREF. As a result, the internal voltage VCORE that is outputted from the internal voltage generation circuit of FIG. 1 in the period C beyond the self-refresh mode becomes higher than that in period B so as to return to the level thereof in period A.

However, when the semiconductor device is in a pre-charge state at the time that the operation period of the semiconductor device is turned from self-refresh mode period B to period C, excessive time is required to restore the level of the internal voltage VCORE to the original level, which may lead to an obstacle to normal operation of the semiconductor device.

In more detail, at the time that the self-refresh mode is completed, the semiconductor device may be in any one of the following two states. That is, one is a self-refresh state where the semiconductor device performs a self-refresh operation. In this self-refresh state, the control signal IRAS is enabled high in level by the row access command, as shown in FIG. 2, so that the active voltage generator 130 is enabled to supply the internal voltage VCORE. The other is a pre-charge state. In this precharge state, the control signal IRAS is disabled to a low level, as shown in FIG. 2, so that the active voltage generator 130 is disabled to supply no internal voltage VCORE. In this case, only the standby voltage generator 120 supplies the internal voltage VCORE.

The case in question is the second case. In this case, when the operation period of the semiconductor device is turned from the self-refresh mode period B to the period C, excessive time is required to restore the level of the internal voltage VCORE to the original level for the active operation of the semiconductor device. That is, in the second case, only the standby voltage generator 120 with the smaller current drive capability is operated to restore the level of the internal voltage VCORE to the high level before entry into the self-refresh mode. For this reason, in this case, a considerably large amount of time is taken to restore the level of the internal voltage VCORE to the original level, thereby making it impossible to restore the level of the internal voltage VCORE to the original level before a time tXSNR from completion of the self-refresh mode until application of a "non read" command elapses, as shown in FIG. 2. As a result, an error may occur in the operation of the semiconductor device.

SUMMARY OF THE INVENTION

Therefore, an internal voltage generation circuit of a semiconductor device is capable of, in a desired operation mode, particularly a self-refresh mode, lowering the level of an internal voltage as compared with that in an active mode and supplying the resulting internal voltage to the semiconductor device, so as to reduce current consumption in the self-refresh mode, and restoring the level of the internal voltage to a normal level for the active mode within a short time after the self-refresh mode is completed, so that the semiconductor device can smoothly perform a normal operation.

An internal voltage generation circuit of a semiconductor device may include a reference voltage generator for generating a reference voltage having different levels depending on the operation mode of the semiconductor device; an active voltage generator for generating an active internal voltage of a level based on the reference voltage; a standby voltage generator for generating a standby internal voltage of a level based on the reference voltage; and an active voltage generation controller for controlling the active voltage generator such that the active voltage generator outputs the active internal voltage in a specific period after completion of a self-refresh mode.

Preferably, the active voltage generation controller includes: a signal output unit responsive to a first control signal, for outputting a second control signal which is enabled in the specific period, the first control signal being enabled in the self-refresh mode and disabled at the same time that the self-refresh mode is completed; and a first logic unit for performing a logic operation with respect to the second control signal and a third control signal which is enabled by a row access command.

Preferably, the signal output unit includes: a delay for delaying the first control signal by a predetermined delay time; a buffer for buffering an output signal from the delay; and a second logic unit for performing a logic operation with respect to the first control signal and an output signal from the buffer and outputting the resulting signal as the second control signal.

The buffer may be an inverter which inverts/buffers the output signal from the delay.

The second logic unit may be a NOR gate which performs a NOR operation with respect to the first control signal and the output signal from the buffer.

The first logic unit may perform an OR operation with respect to the second control signal and the third control signal.

The reference voltage from the reference voltage generator may have a first level in the self-refresh mode and a second level before entry to the self-refresh mode and after the completion of the self-refresh mode, and the second level may be higher than the first level.

Preferably, the active voltage generator includes: a current mirror-type amplifier for comparing the active internal voltage with the reference voltage and amplifying the difference therebetween; a pull-up driver for raising the level of the active internal voltage to the level of the reference voltage when the active internal voltage is lower than the reference voltage; and a switching means for turning on/off the current mirror-type amplifier in response to an output signal from the active voltage generation controller.

The switching means may be disposed between the current mirror-type amplifier and a ground terminal.

Preferably, the current mirror-type amplifier includes: a first pull-down device responsive to the reference voltage and disposed between the switching means and a first node; a second pull-down device responsive to the active internal voltage and disposed between the switching means and a second node; a first pull-up device responsive to a voltage at the second node and disposed between the first node and an external voltage terminal; and a second pull-up device responsive to the voltage at the second node and disposed between the second node and the external voltage terminal.

Preferably, the reference voltage generator includes: an initial reference voltage output unit for outputting an initial reference voltage of a predetermined level; a voltage divider for dividing the initial reference voltage into a first reference voltage and a second reference voltage; and a multiplexer responsive to a control signal which is enabled in the self-refresh mode, for outputting the second reference voltage as the reference voltage when the control signal is enabled, and the first reference voltage as the reference voltage when the control signal is disabled.

Preferably, the multiplexer includes: a first switch for outputting the second reference voltage in response to the control signal; and a second switch for outputting the first reference voltage in response to an inverted signal of the control signal.

The voltage divider may include a plurality of resistors for dividing the initial reference voltage.

An internal voltage generation circuit of a semiconductor device may include a reference voltage generator for generating a reference voltage having different levels depending on the operation mode of the semiconductor device; an active voltage generator for generating an active internal voltage of a level based on the reference voltage; a standby voltage generator for generating a standby internal voltage of a level based on the reference voltage; and an active voltage generation controller for controlling the active voltage generator such that the active voltage generator outputs the active internal voltage in a specific period after completion of a specific operation mode, among the operation modes of the semiconductor device, in which the reference voltage from the reference voltage generator has a lower level than those in the other operation modes.

The specific operation mode may be a self-refresh mode.

Preferably, the active voltage generation controller includes: a signal output unit responsive to a first control signal, for outputting a second control signal which is enabled in the specific period, the first control signal being enabled in the specific operation mode and disabled at the same time that the specific operation mode is completed; and a first logic unit for performing a logic operation with respect to the second control signal and a third control signal which is enabled by a row access command.

Preferably, the signal output unit includes: a delay for delaying the first control signal by a predetermined delay time; a buffer for buffering an output signal from the delay; and a second logic unit for performing a logic operation with respect to the first control signal and an output signal from the buffer and outputting the resulting signal as the second control signal.

The buffer may be an inverter which inverts/buffers the output signal from the delay.

The second logic unit may be a NOR gate which performs a NOR operation with respect to the first control signal and the output signal from the buffer.

The first logic unit may perform an OR operation with respect to the second control signal and the third control signal.

The reference voltage from the reference voltage generator may have a first level in the specific operation mode and a second level before entry to the specific operation mode and after the completion of the specific operation mode, and the second level may be higher than the first level.

Preferably, the active voltage generator includes: a current mirror-type amplifier for comparing the active internal voltage with the reference voltage and amplifying the difference therebetween; a pull-up driver for raising the level of the active internal voltage to the level of the reference voltage when the active internal voltage is lower than the reference voltage; and switching means disposed between the current mirror-type amplifier and a ground terminal for turning on/off the current mirror-type amplifier in response to an output signal from the active voltage generation controller.

Preferably, the current mirror-type amplifier includes: a first pull-down means responsive to the reference voltage and disposed between the switching means and a first node; second pull-down means responsive to the active internal voltage and disposed between the switching means and a second node; first pull-up means responsive to a voltage at the second node and disposed between the first node and an external voltage terminal; and second pull-up means responsive to the voltage at the second node and disposed between the second node and the external voltage terminal.

BRIEF DESCRIPTION OF THE DRAWINGS

Various features and advantages of the present invention will be more clearly understood from the following detailed description taken in conjunction with the accompanying drawings, in which.

DESCRIPTION OF THE PREFERRED EMBODIMENTS

Figure 1:
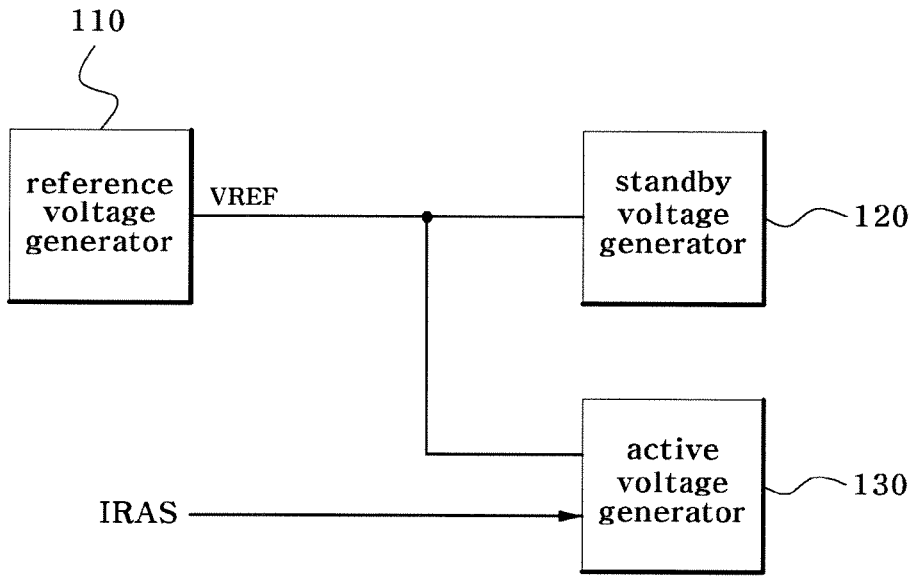
FIG. 1 (PRIOR ART)
FIG. 1 is a block diagram showing the configuration of a conventional internal voltage generation circuit of a semiconductor device.
Figure 2:
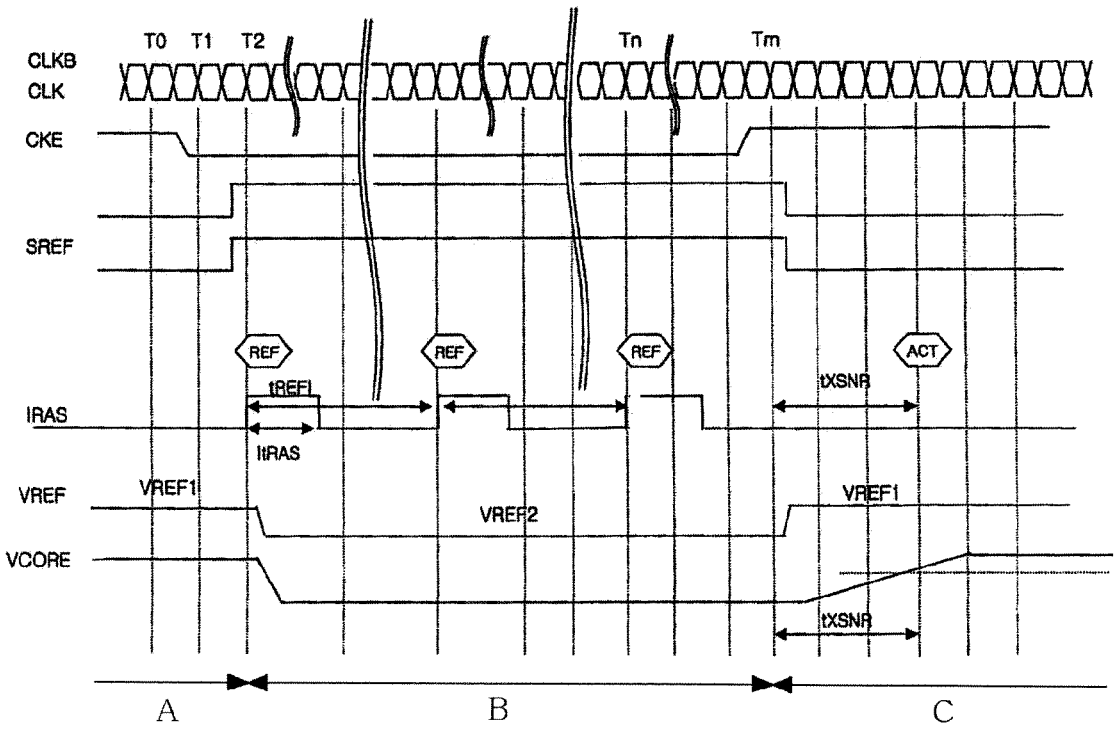
FIG. 2 (PRIOR ART)
FIG. 2 is a timing diagram illustrating the operation of the conventional internal voltage generation circuit of the semiconductor device.

Reference will now be made in detail to the preferred embodiments of the present invention, examples of which are illustrated in the accompanying drawings, wherein like reference numerals refer to like elements throughout. The embodiments are described below to explain the present invention by referring to the figures.

Although the present invention will hereinafter be mainly described in connection with a semiconductor device that supplies an internal voltage of a lower level in a self-refresh mode, it is not limited thereto. For example, the present invention is applicable to any semiconductor devices that supply internal voltages of different levels in different operation modes to reduce current consumption.

Figure 3:
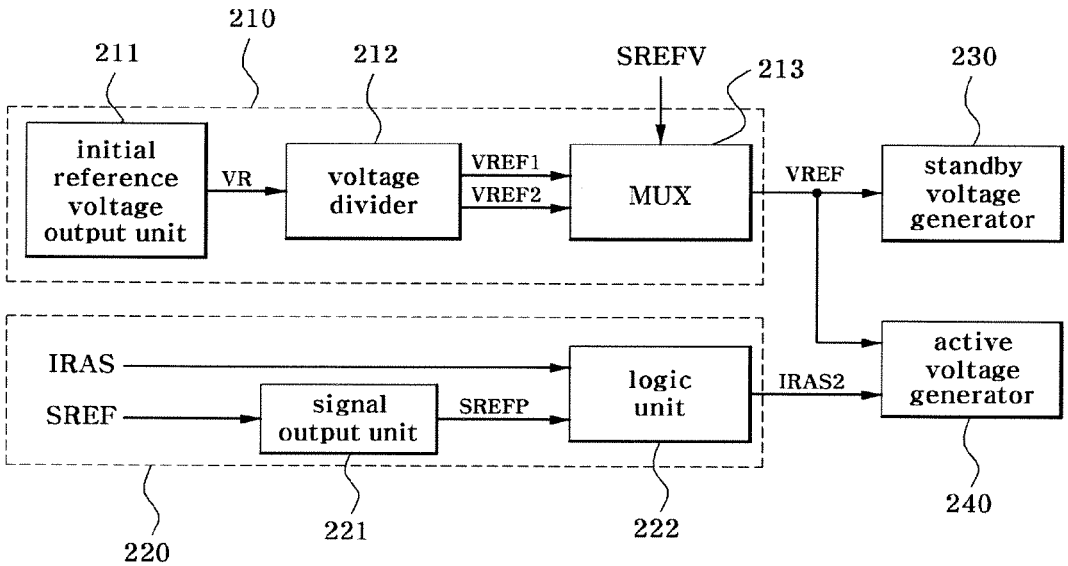
FIG. 3 is a block diagram showing the configuration of an internal voltage generation circuit of a semiconductor device according to an exemplary embodiment of the present invention.

FIG. 3 shows the configuration of an internal voltage generation circuit of a semiconductor device according to an exemplary embodiment of the present invention, and FIGS. 4 to 7 show the configurations of a reference voltage generator, standby voltage generator, active voltage generator and active voltage generation controller in the internal voltage generation circuit according to this embodiment, respectively. The present invention will hereinafter be described with reference to these figures.

As shown in FIG. 3, the internal voltage generation circuit according to the present embodiment comprises a reference voltage generator 210 for generating a reference voltage VREF having different levels depending on different operation modes of the semiconductor device, an active voltage generation controller 220 for outputting an active voltage enable signal IRAS2 which is enabled in a specific period after completion of a self-refresh mode and in a row access period, an active voltage generator 240 which is enabled in response to the active voltage enable signal IRAS2 to generate an active internal voltage VCORE-1 of a level based on the reference voltage VREF, and a standby voltage generator 230 for generating a standby internal voltage VCORE-2 of a level based on the reference voltage VREF.

The active voltage generation controller 220 includes a signal output unit 221 for receiving a self-refresh signal SREF which is enabled in the self-refresh mode and outputting a control signal SREFP which is enabled in the specific period if the self-refresh signal SREF is disabled at the same time the self-refresh mode is completed, and a logic unit 222 for ORing the control signal SREFP and a control signal IRAS which is enabled by a row access command and outputting the ORed result as the active voltage enabled signal IRAS2.

Figure 7:
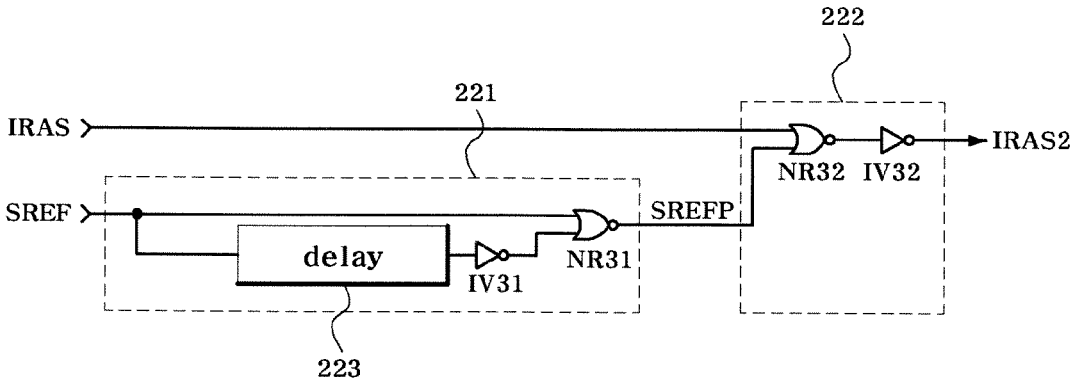
FIG. 7 is a circuit diagram of an active voltage generation controller in the internal voltage generation circuit of the semiconductor device according to the exemplary embodiment of the present invention.

As shown in FIG. 7, the signal output unit 221 includes a delay 223 for delaying the self-refresh signal SREF by a predetermined delay time, an inverter IV31 for inverting/buffering an output signal from the delay 223, and a NOR gate NR31 for NORing the self-refresh signal SREF and an output signal from the inverter IV31 and outputting the NORed result as the control signal SREFP.

Figure 6:
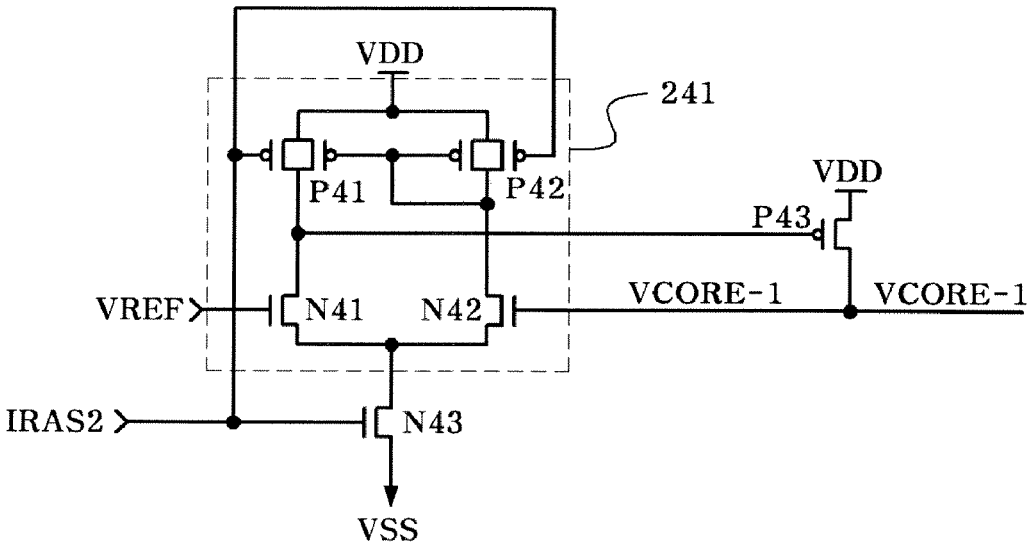
FIG. 6 is a circuit diagram of an active voltage generator in the internal voltage generation circuit of the semiconductor device according to the exemplary embodiment of the present invention.

As shown in FIG. 6, the active voltage generator 240 includes a current mirror-type amplifier 241 for comparing the active internal voltage VCORE-1 with the reference voltage VREF and amplifying the difference therebetween, a PMOS transistor P43 for raising the level of the active internal voltage VCORE-1 to the level of the reference voltage VREF when the active internal voltage VCORE-1 is lower than the reference voltage VREF, and an NMOS transistor N43 that is switching means for turning on/off the current mirror-type amplifier 241 in response to the active voltage enable signal IRAS2.

Figure 4:
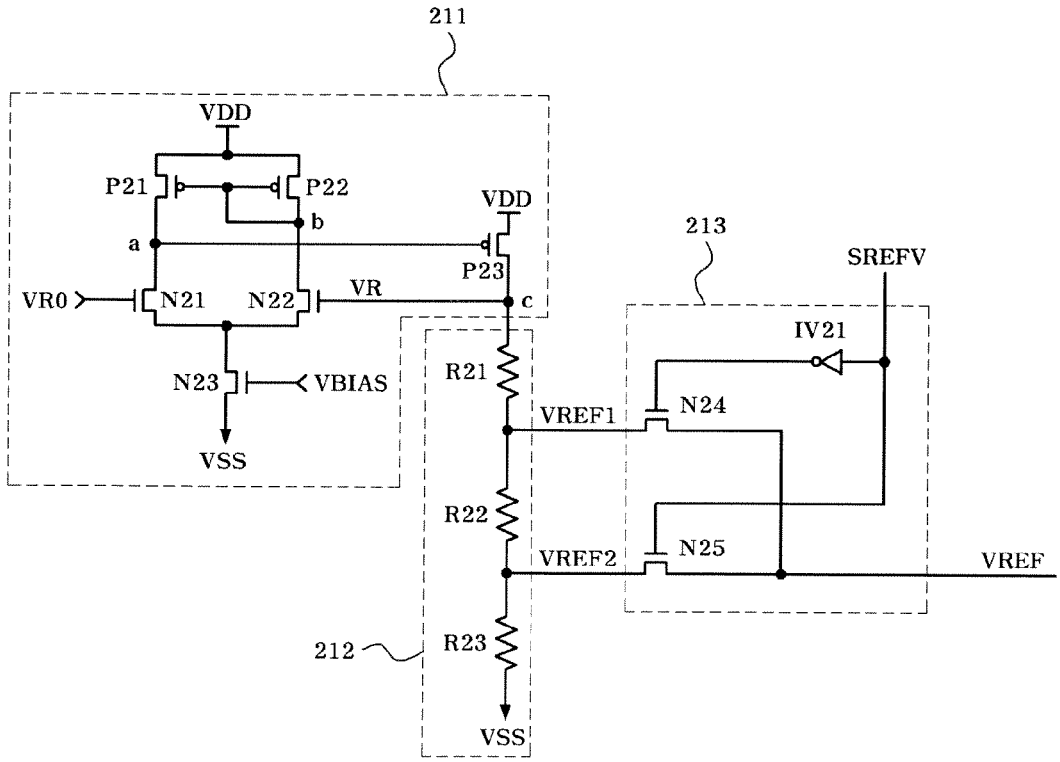
FIG. 4 is a circuit diagram of a reference voltage generator in the internal voltage generation circuit of the semiconductor device according to the exemplary embodiment of the present invention.
Figure 5:
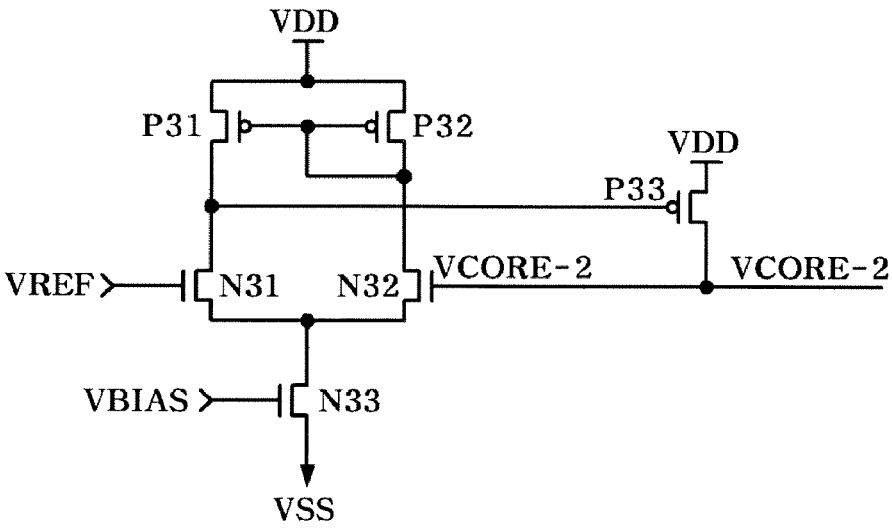
FIG. 5 is a circuit diagram of a standby voltage generator in the internal voltage generation circuit of the semiconductor device according to the exemplary embodiment of the present invention.

As shown in FIG. 4, the reference voltage generator 210 includes an initial reference voltage output unit 211 for outputting an initial reference voltage VR of a predetermined level, a voltage divider 212 for dividing the initial reference voltage VR into a first reference voltage VREF1 and a second reference voltage VREF2, and a multiplexer (MUX) 213 operated in response to a control signal SREFV which is enabled in the self-refresh mode. The MUX 213 functions to output the second reference voltage VREF2 as the reference voltage VREF when the control signal SREFV is enabled, and the first reference voltage VREF1 as the reference voltage VREF when the control signal SREFV is disabled.

The operation of the internal voltage generation circuit with the above-stated configuration according to the present embodiment will hereinafter be described in detail with reference to FIGS. 3 to 9 under the condition that the operation period of the semiconductor device is divided into a period D before the semiconductor device enters the self-refresh mode, a self-refresh mode period E, and a period F after the semiconductor device exits the self-refresh mode.

First, a description will be given of the operation of the internal voltage generation circuit in the period D before the semiconductor device enters the self-refresh mode. In the period D, the self-refresh signal SREF and the control signal SREFV are both low in level. As a result, the reference voltage generator 210 outputs the reference voltage VREF1 of the higher level, as will hereinafter be described in detail. Here, the self-refresh signal SREF and the control signal SREFV are enabled to a high level when the semiconductor device enters the self-refresh mode, and disabled to a low level when a clock enable signal CKE makes a low to high level transition.

In FIG. 4, the initial reference voltage output unit 211 outputs the initial reference voltage VR by comparing the initial reference voltage VR with a predetermined voltage VR0 and amplifying the difference therebetween. In detail, if the voltage VR is lower than the voltage VR0 under the condition that a voltage VBIAS is applied to the gate of an NMOS transistor N23 to turn on the NMOS transistor N23, an NMOS transistor N21 is turned on, so that a node a is pulled down to a ground level. As a result, a PMOS transistor P23 is turned on, and a node c is thus pulled up so that the potential thereof can rise. On the contrary, if the voltage VR is higher than the voltage VR0, an NMOS transistor N22 is turned on, thereby causing a node b to be pulled down to the ground level. Then, a low-level signal from the node b is applied to the gate of a PMOS transistor P21 to turn on the PMOS transistor P21, thus pulling the node a up to a high level. As a result, the PMOS transistor P23 is turned off, so that the potential of the node c falls. By repeating the above operation, the initial reference voltage output unit 211 supplies the initial reference voltage VR to the voltage divider 212 while maintaining it at a constant level.

The voltage divider 212 divides the initial reference voltage VR by a resistor R21, resistor R22 and resistor R23 into two voltages, the first reference voltage VREF1 and the second reference voltage VREF2. Here, as a result of the voltage division, the first reference voltage VREF1 is higher than the second reference voltage VREF2.

The MUX 213 outputs the first reference voltage VREF1 and the second reference voltage VREF2 discriminately depending on the operation mode of the semiconductor device. That is, when the semiconductor device enters the self-refresh mode, the control signal SREFV is enabled high in level, thereby causing an NMOS transistor N25 to be turned on. Thus, the second reference voltage VREF2 of the lower level is outputted as the reference voltage VREF. In contrast, before the semiconductor device enters the self-refresh mode or after the self-refresh mode is completed, the control signal SREFV is disabled low in level, thereby causing an NMOS transistor N24 to be turned on. As a result, the first reference voltage VREF1 of the higher level is outputted as the reference voltage VREF.

Figure 9:
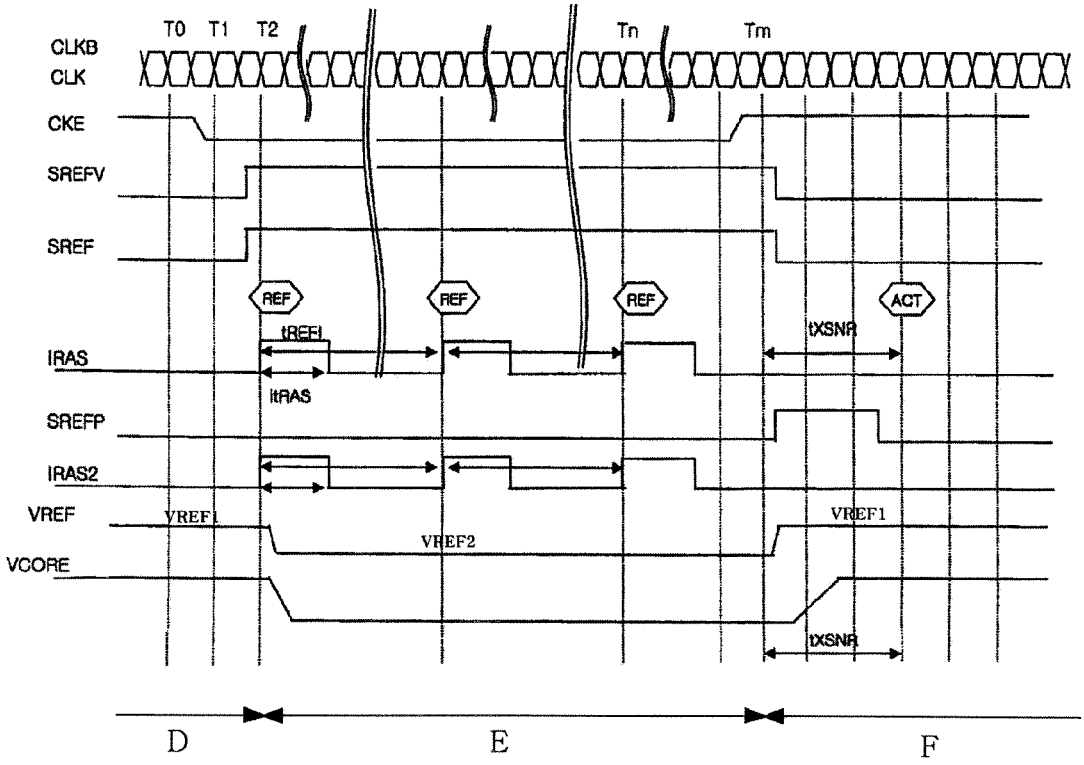
FIG. 9 is a timing diagram illustrating the operation of the internal voltage generation circuit of the semiconductor device according to the exemplary embodiment of the present invention.

Therefore, in the period D before the semiconductor device enters the self-refresh mode, the first reference voltage VREF1 of the higher level is outputted from the reference voltage generator 210 as the reference voltage VREF, as shown in FIG. 9. Then, as shown in FIG. 9, the standby voltage generator 230 outputs the standby internal voltage VCORE-2 of the higher level on the basis of the first reference voltage VREF1 in the same manner as the initial reference voltage output unit 211. That is, by comparing the standby internal voltage VCORE-2 with the first reference voltage VREF1 and amplifying the difference therebetween, the standby voltage generator 230 outputs the standby internal voltage VCORE-2 while maintaining it at a constant level. Therefore, an internal voltage VCORE which is outputted from the internal voltage generation circuit according to the present embodiment has a higher level in the period D before the semiconductor device enters the self-refresh mode. Here, the internal voltage outputted from the standby voltage generator 230 is referred to as the standby internal voltage for the purpose of being distinguished from the internal voltage outputted from the active voltage generator 240, namely, the active internal voltage, to be described later. These two internal voltages are used as the internal voltage VCORE of the semiconductor device.

Next, a description will be given of the operation of the internal voltage generation circuit in the self-refresh mode period E. In the period E, the self-refresh signal SREF and the control signal SREFV are both high in level. As a result, the reference voltage generator 210 outputs the reference voltage VREF2 of the lower level, as will hereinafter be described in detail.

In FIG. 4, by comparing the initial reference voltage VR with the predetermined voltage VR0 and amplifying the difference therebetween, in the same manner as the above, the initial reference voltage output unit 211 supplies the initial reference voltage VR to the voltage divider 212 while maintaining it at a constant level. Then, the voltage divider 212 divides the initial reference voltage VR by the resistor R21, resistor R22 and resistor R23 into two voltages, the first reference voltage VREF1 and the second reference voltage VREF2.

When the semiconductor device is in the self-refresh mode, the control signal SREFV is enabled to a high level, thereby causing the NMOS transistor N25 to be turned on. As a result, the second reference voltage VREF2 is outputted as the reference voltage VREF. Therefore, in the self-refresh mode period E, the second reference voltage VREF2 of the lower level is outputted from the reference voltage generator 210 as the reference voltage VREF, as shown in FIG. 9.

Then, as shown in FIG. 9, the standby voltage generator 230 outputs the standby internal voltage VCORE-2 of the lower level on the basis of the second reference voltage VREF2 in the same manner as above. That is, by comparing the standby internal voltage VCORE-2 with the second reference voltage VREF2 and amplifying the difference therebetween, the standby voltage generator 230 outputs the standby internal voltage VCORE-2 while maintaining it at a constant level. Therefore, the internal voltage VCORE which is outputted from the internal voltage generation circuit according to the present embodiment has a lower level in the self-refresh mode period E.

Meanwhile, in a period in which a refresh operation is actually performed in the self-refresh mode period E, the active voltage generator 240 is also turned on to output the active internal voltage VCORE-1, as will hereinafter be described in detail. Here, the internal voltage outputted from the active voltage generator 240 is referred to as the active internal voltage for the purpose of being distinguished from the standby internal voltage.

At the time that the semiconductor device starts the refresh operation, the control signal IRAS in FIG. 7 is enabled from a low to high level. Here, the control signal IRAS is enabled by the row access command. That is, the control signal IRAS is enabled to a high level upon input of a row access signal /RAS and then maintained at a high level for the row access period. Thereafter, the control signal IRAS is disabled to a low level at the time that the semiconductor device enters a precharge state. As a result, the control signal IRAS is enabled to a high level in the refresh operation, which is a row access operation. For reference, the row access period signifies a period in which row access operations including a data output operation, a data input operation, the refresh operation, etc. are actually performed in response to the input of the row access signal /RAS.

As shown in FIGS. 3 and 7, the active voltage generation controller 220 outputs the active voltage enabling signal IRAS2 in response to the control signal IRAS and the self-refresh signal SREF, as will hereinafter be described in detail.

In the period in which the self-refresh operation is actually performed in the self-refresh mode period E, the control signal IRAS and the self-refresh signal SREF are both high in level. As a result, in FIG. 7, the control signal SREFP, or the output signal from the NOR gate NR31, assumes a low level. This low-level signal is inputted to one input terminal of a NOR gate NR32. However, because the control signal IRAS inputted to the other input terminal of the NOR gate NR32 is high in level, the active voltage enabling signal IRAS2 is enabled to a high level.

Thus, the active voltage generator 240 is enabled in response to the active voltage enabling signal IRAS2 to output the active internal voltage VCORE-1 of the lower level on the basis of the second reference voltage VREF2, as shown in FIG. 9, in the same manner as the standby voltage generator 230. That is, by comparing the active internal voltage VCORE-1 with the second reference voltage VREF2 and amplifying the difference therebetween, the active voltage generator 240 outputs the active internal voltage VCORE-1 while maintaining it at a constant level. Accordingly, in the period in which the refresh operation is performed, in addition to the standby voltage generator 230, the active voltage generator 40 generates and supplies the internal voltage VCORE.

In this manner, in the self-refresh mode period E, the internal voltage generation circuit according to the present embodiment supplies the internal voltage VCORE of the lower level than that in the period D prior to the self refresh mode, so as to reduce unnecessary consumption of current.

Next, a description will be given of the operation of the internal voltage generation circuit in the period F after the semiconductor device exits the self-refresh mode. At the time that the operation period of the semiconductor device is turned to the period F, both the self-refresh signal SREF and control signal SREFV go from a high to low level. As a result, the reference voltage generator 210 of FIG. 4 outputs the reference voltage VREF1 of the higher level, as will hereinafter be described in detail.

As stated previously, in FIG. 4, the initial reference voltage output unit 211 and the voltage divider 212 cooperate to output the first reference voltage VREF1 and the second reference voltage VREF2. At the time that the semiconductor device departs from the self-refresh mode, the control signal SREFV is disabled to a low level, thereby causing the NMOS transistor N24 to be turned on. As a result, in the period F beyond the self-refresh mode, the first reference voltage VREF1 of the higher level is outputted from the reference voltage generator 210 as the reference voltage VREF, as shown in FIG. 9.

Conventionally, when the semiconductor device is in the precharge state at the time that the self-refresh mode is completed, excessive time is disadvantageously required to restore the level of the internal voltage VCORE to the original level for the active operation of the semiconductor device, namely, the high level before entry into the self-refresh mode. However, in the present embodiment, this problem does not occur as will hereinafter be described.

First, the standby voltage generator 230 is operated to output the standby internal voltage VCORE-2 of the higher level on the basis of the first reference voltage VREF1, as shown in FIG. 9.

Figure 8:
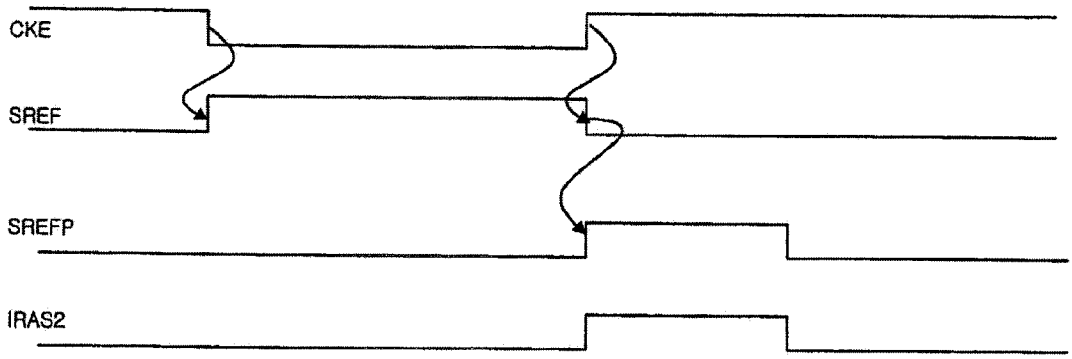
FIG. 8 is a waveform diagram of signals in the active voltage generation controller of FIG. 7.

The active voltage generator 240 is also operated at the same time that the semiconductor device departs from the self-refresh mode. That is, at the time that the semiconductor device exits the self-refresh mode, the self-refresh signal SREF makes a high to low level transition, as shown in FIGS. 8 and 9. As a result, the low-level signal is inputted to one input terminal of the NOR gate NR31, as shown in FIG. 7. This low-level signal is also inputted to the other input terminal of the NOR gate NR31 after being delayed by the predetermined delay time by the delay 223. Accordingly, in a period from the high to low level transition of the self-refresh signal SREF until the lapse of the delay time, the signal at the other input terminal of the NOR gate NR31 is maintained at a previously low level. Accordingly, in the period from the high to low level transition of the self-refresh signal SREF until the lapse of the delay time, the control signal SREFP assumes a high level, so that the active voltage enabling signal IRAS2 is enabled to a high level.

Therefore, the active voltage generator 240 is enabled in response to the active voltage enabling signal IRAS2 to output the active internal voltage VCORE-1 of the higher level on the basis of the first reference voltage VREF1, as shown in FIG. 9, in the same manner as the above. Here, the active voltage generator 240 outputs the internal voltage with a drive capability much higher than that of the standby voltage generator 230. Accordingly, the active voltage generator 40 generates and supplies the internal voltage VCORE together with the standby voltage generator 230, thereby making it possible to raise the level of the internal voltage VCORE to the original level before the self-refresh mode within a short time after the self-refresh mode is completed and to stabilize the internal voltage before a time tXSNR elapses. The delay time of the delay 223 determines the specific period in which the active voltage enabling signal IRAS2 is enabled after the completion of the self-refresh mode. This delay time can be properly adjusted according to system environments such that the internal voltage can return to the original level before the time tXSNR elapses after the self-refresh mode is completed.

As described above, in the internal voltage generation circuit according to the present embodiment, in addition to the standby voltage generator 230, the active voltage generator 240 is enabled for the predetermined time after the completion of the self-refresh mode so that the internal voltage can rapidly return to the normal level for the active operation. Therefore, the semiconductor device can smoothly perform the normal operation.

Although the present invention has been mainly described in connection with the semiconductor device that supplies the internal voltage of the lower level in the self-refresh mode, it is not limited thereto. For example, the present invention is applicable to any semiconductor devices that supply internal voltages of different levels in different operation modes to reduce current consumption.

As apparent from the above description, the present invention provides an internal voltage generation circuit of a semiconductor device which is capable of, in a desired operation mode, particularly a self-refresh mode, lowering the level of an internal voltage as compared with that in an active mode and supplying the resulting internal voltage to the semiconductor device, so as to reduce current consumption in the self-refresh mode. An active voltage generator is enabled for a predetermined time after completion of the self-refresh mode to rapidly restore the level of internal voltage to a normal level for the active mode. Therefore, the semiconductor device can smoothly perform a normal operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims

What is claimed is:

1. An internal voltage generation circuit of a semiconductor device comprising:

a reference voltage generator for generating a reference voltage having different levels depending on the operation mode of an semiconductor device;

an active voltage generator for generating an active internal voltage of a level based on the reference voltage;

a standby voltage generator for generating a standby internal voltage of a level based on the reference voltage; and an active voltage generation controller for controlling the active voltage generator such that the active voltage generator outputs the active internal voltage in a specific period after completion of a self-refresh mode; and wherein the reference voltage generator includes an initial reference voltage output unit for outputting an initial reference voltage of a predetermined level;

a voltage divider for dividing the initial reference voltage into a first reference voltage and a second reference voltage; and a multiplexer responsive to a control signal which is enabled in the self-refresh mode, for outputting the second reference voltage as the reference voltage when the control signal is enabled, and the first reference voltage as the reference voltage when the control signal is disabled.

2. The internal voltage generation circuit as set forth in claim 1, wherein the active voltage generation controller includes:

a signal output unit responsive to a first control signal, for outputting a second control signal which is enabled in the specific period, the first control signal being enabled in the self-refresh mode and disabled at the same time the self-refresh mode is completed; and a first logic unit for performing a logic operation with respect to the second control signal and a third control signal which is enabled by a row access command.

3. The internal voltage generation circuit as set forth in claim 2, wherein the signal output unit includes:

a delay for delaying the first control signal by a predetermined delay time;

a buffer for buffering an output signal from the delay; and a second logic unit for performing a logic operation with respect to the first control signal and an output signal from the buffer and outputting the resulting signal as the second control signal.

4. The internal voltage generation circuit as set forth in claim 3, wherein the buffer is an inverter, the inverter inverting/buffering the output signal from the delay.

5. The internal voltage generation circuit as set forth in claim 3, wherein the second logic unit is a NOR gate, the NOR gate performing a NOR operation.

6. The internal voltage generation circuit as set forth in claim 2, wherein the first logic unit is adapted to perform an OR operation.

7. The internal voltage generation circuit as set forth in claim 1, wherein the reference voltage from the reference voltage generator has a first level in the self-refresh mode and a second level before entry to the self-refresh mode and after the completion of the self-refresh mode, the second level being higher than the first level.

8. The internal voltage generation circuit as set forth in claim 1, wherein the active voltage generator includes:

a current mirror-type amplifier for comparing the active internal voltage with the reference voltage and amplifying the difference therebetween;

a pull-up driver for raising the level of the active internal voltage to the level of the reference voltage when the active internal voltage is lower than the reference voltage; and a switching means for turning on/off the current mirror-type amplifier in response to an output signal from the active voltage generation controller.

9. The internal voltage generation circuit as set forth in claim 8, wherein the switching means is disposed between the current mirror-type amplifier and a ground terminal.

10. The internal voltage generation circuit as set forth in claim 9, wherein the current mirror-type amplifier includes:

a first pull-down device responsive to the reference voltage and disposed between the switching means and a first node;

a second pull-down device responsive to the active internal voltage and disposed between the switching means and a second node;

a first pull-up device responsive to a voltage at the second node and disposed between the first node and an external voltage terminal; and a second pull-up device responsive to the voltage at the second node and disposed between the second node and the external voltage terminal.

11. The internal voltage generation circuit as set forth in claim 1, wherein the multiplexer includes:

a first switch for outputting the second reference voltage in response to the control signal; and a second switch for outputting the first reference voltage in response to an inverted signal of the control signal.

12. The internal voltage generation circuit as set forth in claim 1, wherein the voltage divider includes a plurality of resistors for dividing the initial reference voltage.

13. An internal voltage generation circuit of a semiconductor device comprising:

a reference voltage generator for generating a reference voltage having different levels depending on the operation mode of the semiconductor device;

an active voltage generator for generating an active internal voltage of a level based on the reference voltage;

a standby voltage generator for generating a standby internal voltage of a level based on the reference voltage; and an active voltage generation controller for controlling the active voltage generator such that the active voltage generator outputs the active internal voltage in a specific period after completion of a specific operation mode, among the operation modes of the semiconductor device, in which the reference voltage from the reference voltage generator has a lower level than those in the other operation modes; and wherein the reference voltage generator includes an initial reference voltage output unit for outputting an initial reference voltage of predetermined level;

a voltage divider for dividing the initial reference voltage into a first reference voltage and a second reference voltage; and a multiplexer responsive to a control signal which is enabled in the self-refresh mode, for outputting the second reference voltage as the reference voltage when the control signal is enabled, and the first reference voltage as the reference voltage when the control signal is disabled.

14. The internal voltage generation circuit as set forth in claim 13, wherein the specific operation mode is a self-refresh mode.

15. The internal voltage generation circuit as set forth in claim 13, wherein the active voltage generation controller includes:

a signal output unit responsive to a first control signal, for outputting a second control signal which is enabled in the specific period, the first control signal being enabled in the specific operation mode and disabled at the same time the specific operation mode is completed; and a first logic unit for performing a logic operation with respect to the second control signal and a third control signal which is enabled by a row access command.

16. The internal voltage generation circuit as set forth in claim 15, wherein the signal output unit includes:

a delay for delaying the first control signal by a predetermined delay time;

a buffer for buffering an output signal from the delay; and a second logic unit for performing a logic operation with respect to the first control signal and an output signal from the buffer and outputting the resulting signal as the second control signal.

17. The internal voltage generation circuit as set forth in claim 16, wherein the buffer is an inverter, the inverter inverting/buffering the output signal from the delay.

18. The internal voltage generation circuit as set forth in claim 16, wherein the second logic unit is a NOR gate, the NOR gate performing a NOR operation.

19. The internal voltage generation circuit as set forth in claim 15, wherein the first logic unit is adapted to perform an OR operation.

20. The internal voltage generation circuit as set forth in claim 13, wherein the reference voltage from the reference voltage generator has a first level in the specific operation mode and a second level before entry to the specific operation mode and after the completion of the specific operation mode, the second level being higher than the first level.

21. The internal voltage generation circuit as set forth in claim 13, wherein the active voltage generator includes:

a current mirror-type amplifier for comparing the active internal voltage with the reference voltage and amplifying the difference therebetween;

a pull-up driver for raising the level of the active internal voltage to the level of the reference voltage when the active internal voltage is lower than the reference voltage; and a switching means disposed between the current mirror-type amplifier and a ground terminal for turning on/off the current mirror-type amplifier in response to an output signal from the active voltage generation controller.

22. The internal voltage generation circuit as set forth in claim 21, wherein the current mirror-type amplifier includes:

a first pull-down device responsive to the reference voltage and disposed between the switching means and a first node;

a second pull-down device responsive to the active internal voltage and disposed between the switching means and a second node;

a first pull-up device responsive to a voltage at the second node and disposed between the first node and an external voltage terminal; and a second pull-up device responsive to the voltage at the second node and disposed between the second node and the external voltage terminal.

* * * * *

UNITED STATES PATENT AND TRADEMARK OFFICE

CERTIFICATE OF CORRECTION

PATENT NO. : 7,319,361 B2
APPLICATION NO. : 11/275419
DATED : January 15, 2008
INVENTOR(S) : Seung E. Jin It is certified that error appears in the above-identified patent and that said Letters Patent is hereby corrected as shown below:

At Column 11, line 36, “reforence” should be -- reference --.

Signed and Sealed this

First Day of July, 2008

JON W. DUDAS
*Director of the United States Patent and Trademark Office*